United States Patent [19]

Reil

[11] Patent Number: 4,796,802

[45] Date of Patent: Jan. 10, 1989

[54] FLUID PACK WITH A TAPERED UPPER PORTION

[75] Inventor: Wilhelm Reil, Bensheim, Fed. Rep. of Germany

[73] Assignee: Tetra Park Finance & Trading S.A., Pully, Switzerland

[21] Appl. No.: 66,829

[22] Filed: Jun. 25, 1987

[30] Foreign Application Priority Data

Jun. 28, 1986 [DE] Fed. Rep. of Germany ..... 3621742

[51] Int. Cl.[4] ..... B65D 31/16

[52] U.S. Cl. ..... 229/108; 229/114

[58] Field of Search ..... 229/108, 111, 112, 113, 229/114

[56] References Cited

U.S. PATENT DOCUMENTS

| | | | |
|---|---|---|---|
| 1,342,770 | 6/1920 | Selz | 229/113 |
| 2,483,464 | 10/1949 | Johnson | 229/108 |
| 3,330,466 | 7/1967 | Eckles | 229/132 |
| 3,357,626 | 12/1967 | Carpenter et al. | 220/461 |
| 3,604,491 | 9/1971 | Spless | 383/104 |

FOREIGN PATENT DOCUMENTS

| | | |
|---|---|---|
| 920413 | 11/1954 | Fed. Rep. of Germany . |
| 1110076 | 11/1956 | Fed. Rep. of Germany . |
| 1977365 | 1/1968 | Fed. Rep. of Germany . |
| 6931453 | 12/1969 | Fed. Rep. of Germany . |
| 3139780 | 10/1981 | Fed. Rep. of Germany . |
| 1558100 | 3/1968 | France . |

*Primary Examiner*—Willis Little

*Attorney, Agent, or Firm*—Paul & Paul

[57] ABSTRACT

The invention relates to a pack for filling materials which are capable of flow, comprising a tube which is formed by at least one longitudinal sealing seam and which has a bottom and a top mounted to the ends thereof, of which the top has a pouring opening in the vicinity of its outer edge, wherein the tube comprises carrier material, for example cardboard, which is coated with thermoplastic material at least on one side, and the bottom is quadrangular and is formed from the folded-over tube of the pack in the form of a fold closure.

3 Claims, 2 Drawing Sheets

FLUID PACK WITH A TAPERED UPPER PORTION

Figure 1:
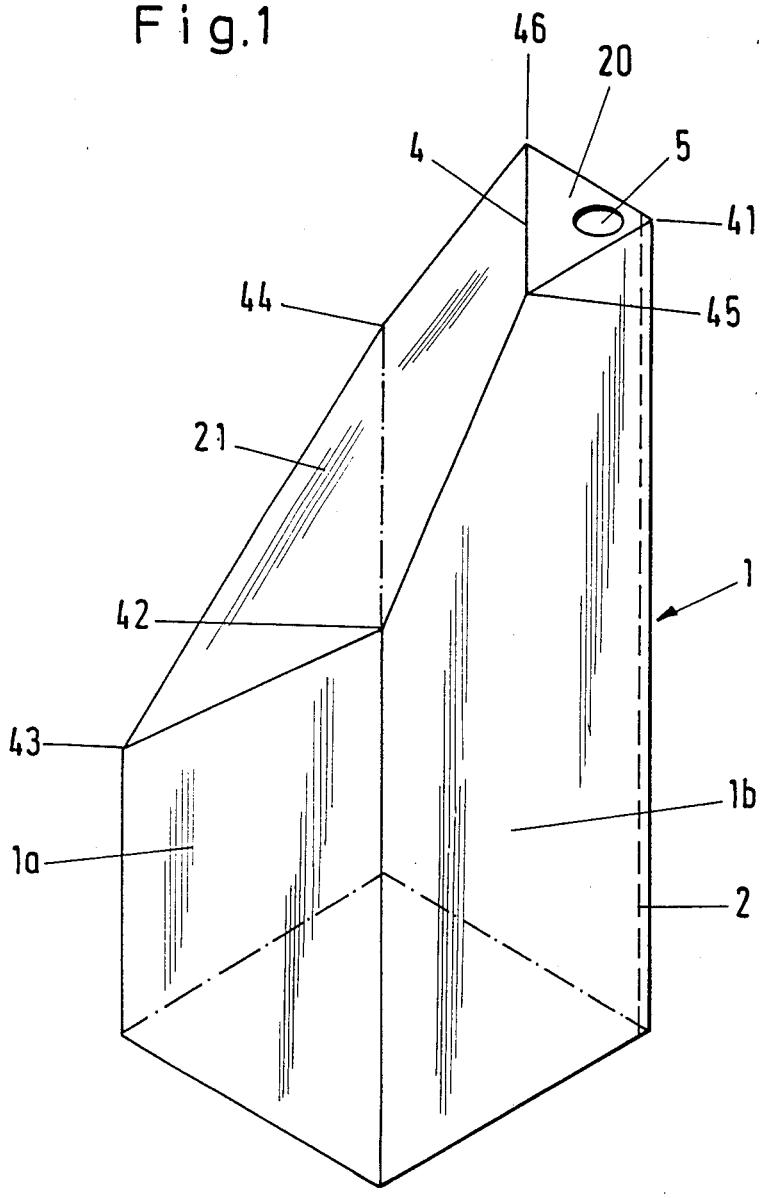

The invention relates to a pack for filling materials which are capable of flow, comprising a tube which is formed by at least one longitudinal sealing seam and which has a bottom and a top mounted to the ends thereof, of which the top has a pouring opening in the vicinity of its outer edge, wherein the tube comprises carrier material, for example cardboard, which is coated with thermoplastic material at least on one side, and the bottom is quadrangular and is formed from the folded-over tube of the pack in the form of a fold closure.

Liquid packs similar to the pack described above are already known. In such packs, the top or lid is round and comprises thermoplastic material without a carrier material so that the top is fitted by injection moulding to the upper edge of the tube. It has been found that the known pack can only be produced at a high level of expenditure and, because of surfaces with different degrees of curvature, in the region of the tube, is difficult to combine together and transport on pallets. The pouring opening of the known pack is disposed at the centre of the round top so that an upwardly projecting collar is always required at the pouring opening because otherwise the liquid in the pack cannot be poured out in the desired manner. The high collar of the pouring arrangement in turn gives rise to other stacking problems, in particular when a plurality of packs are to be piled in layers one above the other.

The object of the present invention is therefore to improve the known pack such as to provide improved pouring and stacking options while nonetheless permitting inexpensive manufacture of the pack.

In accordance with the invention, that object is achieved in that the top has at least four corners and at least a first plane and a second plane which include an angle and of which the first plane is parallel to the plane of the bottom and that at least the second plane is formed from the tube material.

It has admittedly already been proposed that the top or cover of a fluid pack should be of a quadrangular configuration, similar to the kind referred to in the opening part of this specification, with the pouring opening being disposed adjacent one of the four corners. However that top also consisted of thermoplastic material without a carrier or backing material and had to be injection moulded to the top edges of the tube, along lines extending in a sloping configuration in space. In contrast the pack according to the invention has a top which is formed from two planes, wherein at least the second plane is formed from the same material as the tube. Apart from the saving on material when using the material which is not required for forming the tube, the invention also gives the further advantage that in its upper portion, in the vicinity of the top, the pack extends in a tapering convergent configuration so that the volume of the filling material decreases towards the top. If the problem of improved pouring properties of the pack according to the invention is considered, then in particular the length of the level of fluid in the pouring direction plays a part, more specifically, starting from that point at the upper edge of the pack at which the pouring means is disposed, and going from there towards the centre of the top. That length is reduced by virtue of the tapering convergent configuration of the upper portion of the pack, or the bevelling effect as viewed from the side of the pack. When pouring out material from the pack, that means that the pack can be set in a more inclined position, that is to say the plane or line which is at the front in the standing condition, under the pouring spout, can be inclined from the perpendicular into the horizontal to a greater extent than with conventional packs in which the surface of the fluid is greater than in the case of the present invention. In accordance with the invention the pouring operation is more convenient and improved because the fact that the pack when completely filled can be set in a more inclined position before the first material is poured out means that the pouring jet separates better from the pouring edge of the pouring spout, thereby reliably preventing the material from dripping down on the surface or the edge under the pouring spout of the pack.

It is also particularly advantageous in accordance with the invention for the pouring opening to be disposed adjacent a corner and for the second plane of the top to be in diametrally opposite relationship to that corner. Although in accordance with the invention it is in principle also envisaged that, in the case of a top which is quadrangular as viewed from above, the pouring opening may be arranged between two corners but at the outside edge, it has however been found to be particularly practical for the pouring opening to be moved to one of the corners of the top which is quadrangular when viewed from above. In order to shorten the above-described length from the pouring location in the plane of tilting movement of the pack when pouring out material therefrom in a direction towards the oppositely disposed corner of the top or in order to reduce the surface area of the fluid to be poured out, the second plane of the top which in the standing condition of the filled pack when it has not yet been opened is inclined with respect to the horizontal is moved to the side which is in opposite relationship to the corner at the pouring arrangement. In other words in that way the upper portion of the pack is practically diagonally cut off, when it is viewed from the side. That again also gives the advantage that the angle of tilting movement for the pack before the jet of material being poured out of the pack first leaves the pouring opening can be increased. The foregoing embodiment with the pouring opening arranged at a corner and with the bevel in opposite relationship thereto gives advantages in regards to production procedure, because folding of the tube which is made from the coated paper material permits economical and advantageous configurations. For example it is possible to use a double-ply rib for stiffening the top or for mounting lifting handles or the like.

In this connection, in accordance with the invention it is particularly desirable for a handle means to be mounted at the second plane of the top. Although the mounting of a handle means has already been proposed in regard to packs of similar configuration, in conjunction with the top made from the tube material what is involved here is a completely novel feature which permits easy pouring out and good handling of the pack, while using a small amount of material.

Figure 2:
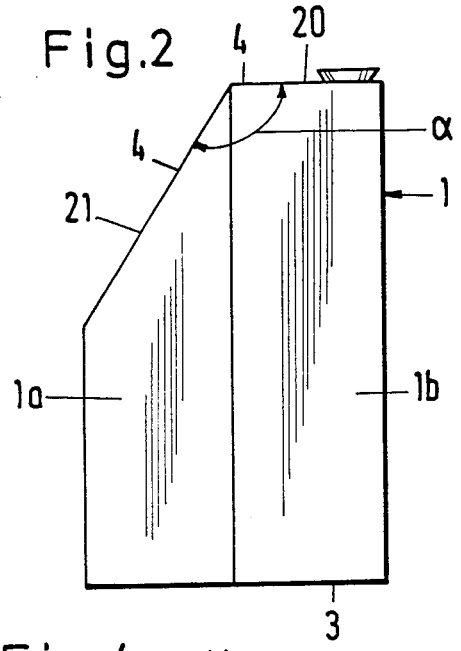
Figure 3:
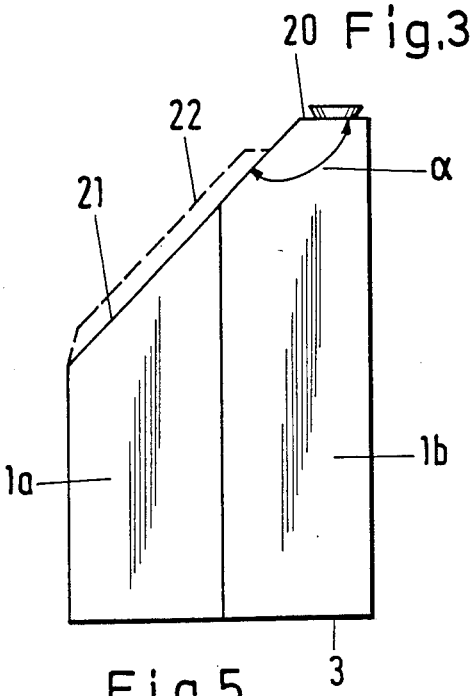
Figure 4:
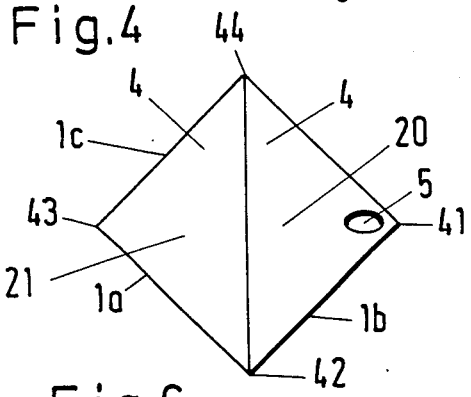
Figure 5:
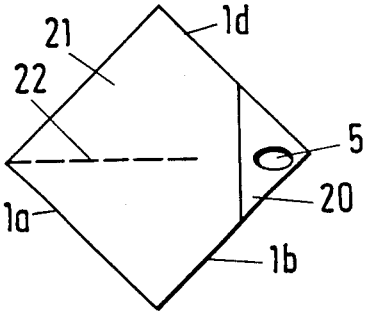
Figure 6:
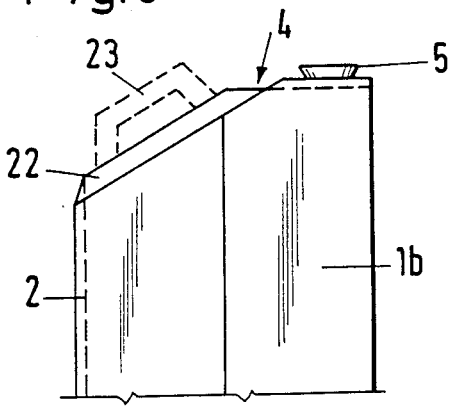
Figure 7:
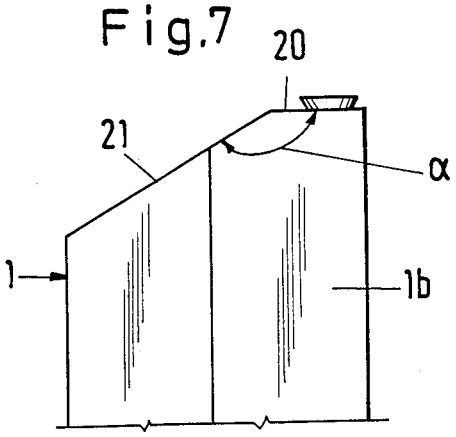

Further advantages, features and possible uses of the present invention will be apparent from the following description of preferred embodiments with reference to the accompanying drawings in which:

FIG. 1 is a diagrammatic perspective view of a fluid pack, without a handle means, FIG. 2 is a side view of a first embodiment of the pack, FIG. 3 is a similar side view to that shown in FIG. 2, for example when viewing FIG. 1 from bottom left towards top right, showing a second embodiment of the pack, FIG. 4 is a plan view of the embodiment of the pack shown in FIG. 2, FIG. 5 is a plan view of the embodiment of the pack shown in FIG. 3, FIG. 6 is a similar side view of those shown in FIGS. 2 and 3, but with a handle means additionally mounted to a centre rib, and FIG. 7 is a similar diagrammatic side view to FIGS. 2, 3 and 6 of a further modified embodiment of the invention in which the pouring opening is disposed not in the vicinity of a corner but between two corners in the vicinity of the edge of the top which connects said corners.

Common to practically all embodiments is the tube of the pack which is generally identified by reference numeral 1 and which forms four side walls which are identified in FIGS. 4 and 5 by references 1*a*, 1*b*, 1*c* and 1*d*, with only two of the side walls being shown in each of the other Figures of drawings. The rectangular shape of the side wall 1*b* will be seen from FIGS. 2 and 4, while the trapezoidal shape of the other side walls or the shape of the side wall 1*b* which is bevelled at one side will be seen in the embodiment shown in FIGS. 1, 3 and 6. The four side walls 1*a*–1*d* are formed into the tube 1 by way of the longitudinal sealing seam 2. The seam 2 may be disposed at the front beneath the pouring opening 5 (see FIG. 1) or at the back in the opposite region of the pack, as shown in FIG. 6.

The bottom which is generally identified by reference numeral 3 is formed in known fashion and is therefore only indicated in FIGS. 2 and 3 by the bottom line, with the plane of the bottom 3 being therebehind.

In some embodiments the top or lid which is generally identified by reference numeral 4 has four corners 41, 42, 43 and 44 (see FIG. 4) whereas in other embodiments it has six corners 41–46 (see FIG. 1). In the embodiments illustrated in the drawings the top 4 is formed by two planes, namely a first plane 20 and a second plane 21 which includes an angle $\alpha$ with the first plane 20. The first plane 20 lies parallel to the plane of the bottom 3 and the second plane 21 therefore shows the pack which is of an upwardly tapering convergent configuration in side view as shown in FIGS. 2, 3, 6 and 7, or the upper portion of the pack which is substantially diagonally cut away. At least the second plane 21 is formed by folding of the blank (not shown herein) for the tube and therefore consists of the same material, namely preferably cardboard or paper which is coated with plastics material on both surfaces. It is also possible however for the first plane 20 and the second plane 21 both to be produced from the tube material and applied to the tube 1 by folding operations.

It will be seen that in embodiments 1–6 the pouring opening 5 is adjacent the so-called front corner 41 of the top 4. In the embodiment shown in FIG. 4 the pouring opening is in the middle for example between the corners 42 and 41 or 41 and 44, but at the edge connecting those corners. At any event the bevel configuration or reduction in volume of the upper portion of the pack always lies, as viewed from the pouring opening 5, in that direction which is directed away from the forward tip of the pouring opening where the fluid first leaves the opening. In all the views shown in FIGS. 1–3 and 6, 7 the forward tip of the pouring opening 5 is arranged at top right and consequently the bevel configuration is shown extending towards bottom left.

FIGS. 3, 5 and 6 also show a cardboard rib 22 which is formed by folding of the second plane 21 and which affords an advantageous anchoring portion for example for a handle means 23 which is shown in FIG. 6.

I claim:

1. A pack for filling materials which are capable of flow, the pack comprising:

a tube formed by at least one longitudinal sealing seam and having two ends the tube comprising a carrier material coated with thermoplastic material on at least one side thereof;

a top having a pouring opening in the vicinity of its outer edge mounted to one end of the tube;

a bottom mounted to the other end of the tube the bottom being quadrangular and formed from the folded-over tube of the pack in the form of a fold closure;

the top having at least corners and least a first plane and a second plane which include an angle, the first plane being parallel to the plane of the bottom, and the second plane being formed from the tube carrier material.

2. A pack according to claim 1 wherein the pouring opening is disposed near a corner, the second plane of the top being in diametrally opposite relationship to the corner.

3. A pack according to claim 1 or claim 2 having a handle means mounted to the second plane of the top.

* * * * *

UNITED STATES PATENT OFFICE

CERTIFICATE OF CORRECTION

Patent No. 4,796,802 Dated January 10, 1989

Inventor(s) Wilhelm Reil

It is certified that error appears in the above-identified patent and that said Letters Patent is hereby corrected as shown below:

35 U.S.C. 254

The name of the assignee should read as "Tetra Pak Finance & Trading S.A." not "Tetra Park Finance & Trading S.A.";

Column 4, line 40, after "least" and before "corners", insert the word -- four --.

Signed and Sealed this

Nineteenth Day of September, 1989

*Attest:*

*Attesting Officer*

DONALD J. QUIGG

*Commissioner of Patents and Trademarks*